US007486197B1

(12) United States Patent
Frazier et al.

(10) Patent No.: US 7,486,197 B1
(45) Date of Patent: Feb. 3, 2009

(54) BLANKET WITH AUDIO DEVICE

(76) Inventors: Leon Frazier, 2811 Penland Ave., Huntsville, AL (US) 35810; Lillie Bettis, 5908 Queen Ann Ct., Mobile, AL (US) 36618

( * ) Notice: Subject to any disclaimer, the term of this patent is extended or adjusted under 35 U.S.C. 154(b) by 227 days.

(21) Appl. No.: 11/438,147

(22) Filed: May 22, 2006

(51) Int. Cl.
*G08B 25/08* (2006.01)

(52) U.S. Cl. ..... 340/692; 2/69.5; 5/417

(58) Field of Classification Search ..... 340/692; 600/28; 2/69.5, 83, 89, 75; 5/419, 417, 494, 5/431, 655

See application file for complete search history.

(56) References Cited

U.S. PATENT DOCUMENTS 4,841,587 A * 6/1989 Carter et al. ..... 5/419
4,972,533 A 11/1990 Brown
5,063,912 A * 11/1991 Hughes ..... 601/47
5,784,733 A * 7/1998 Rasamny et al. ..... 5/482
5,971,761 A * 10/1999 Tillman, Sr. ..... 434/81
6,170,602 B1 1/2001 Mann
6,513,164 B1 * 2/2003 Hearns ..... 2/69.5
7,102,507 B1 * 9/2006 Lauren ..... 340/539.11
2002/0120176 A1 * 8/2002 Coviello ..... 600/28
2003/0151524 A1 * 8/2003 Clark ..... 340/870.07
2006/0132314 A1 * 6/2006 Sok ..... 340/573.1
2007/0241923 A1 * 10/2007 Rothacker ..... 340/692

* cited by examiner

*Primary Examiner*—Benjamin C Lee
*Assistant Examiner*—Hoi C Lau
(74) *Attorney, Agent, or Firm*—Crossley Patent Law; Mark A Crossley

(57) ABSTRACT

A blanket with audio device, which comprises a removable audio device located in the thickness of the blanket under a flap, is disclosed. The flap is both pliable and transparent. The audio device is waterproof and replaceable. The audio device is offered in more than one embodiment, with the preferred embodiment featuring recording, playback, erasure, on/off, voice activated control, and elevated Braille letters for the visually impaired. The audio device is, therefore, visually, manually, audibly, and palpably accessed.

6 Claims, 6 Drawing Sheets

BLANKET WITH AUDIO DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The inclusion of audio devices into blankets is known in the prior art. Reasons indicating the need for the audio devices vary, as do the blankets which include them. Blankets also therefore vary in design and function by their goals. Goals include waking a sleeper or assisting in putting an individual to sleep. The present blanket with audio device offers features to assist in more than one goal. The present blanket enables a sightless individual to operate the blanket. The present blanket assists in educating a child and also in assists a child in sleep.

FIELD OF THE INVENTION

The blanket with audio device relates to blankets and more especially to a child's blanket with audio device.

DESCRIPTION OF THE PRIOR ART

Prior related art offers various children's blankets with particular design and function features. For example, U.S. Pat. No. 6,170,602B1 issued to Mann on Jan. 9, 2001 teaches a sound emitting and vibrating blanket. The sound producing member is permanently within the blanket. The sound producing member is a tape player or a music box. U.S. Pat. No. 5,784,733 issued to Rasamny et al on Jul. 28, 1998 teaches a combination comforter and sleeping bag. The sleeping bag does not offer the same removability of the audio device as does the present blanket with audio device. The sleeping bag does not accommodate a visually impaired user, nor does the sleeping bag offer voice activation. The audio device does not offer the same features of the audio device of the present blanket with audio device. U.S. Pat. No. 4,972,533 issued to Brown on Nov. 27, 1990 teaches a blanket with a compartment housing a sound-producing device. The sound producing device is non-removable. The device offers no features to accommodate the visually impaired, nor a voice activated control.

While the above-described devices fulfill their respective and particular objects and requirements, they do not describe a blanket with audio device that provides for the advantages of the present blanket with audio device. In this respect, the present blanket with audio device substantially departs from the conventional concepts and designs of the prior art. Therefore, a need exists for an improved blanket with audio device.

SUMMARY OF THE INVENTION

The general purpose of the blanket with audio device, described subsequently in greater detail, is to provide a blanket with audio device which has many novel features that result in an improved blanket with audio device which is not anticipated, rendered obvious, suggested, or even implied by prior art, either alone or in combination thereof.

To attain this, the blanket with audio device provides an individual, especially a child, with lullabies, personally recorded message, or music. The audio device is fitted into a recession in the thickness of the blanket and is covered with a flap, preferably held in place by hook and loop. The recession provides typical blanket appearance and use. The flap in the preferred embodiment is transparent so that controls can be visually accessed. The flap is highly pliable to enable control use through the flap. The audio device is both removable and waterproof. The audio device is thereby replaceable if needed or desired and can be removed for washing the blanket. The replaceable audio device feature enables future updating of audio device features. The waterproof device also prevents damage in case of exposure to urine or other liquids. More than one embodiment of the audio device is provided.

One embodiment provides an audio device with speaker and with an on/off switch which is elevated above the case of the audio device. The elevated on/off provides for tactical distinction and therefore easier operation by visually impaired. An added feature of this embodiment includes an optional voice activated sensor/switch also. The voice activation is not only convenient but also provides a potential learned action and response for an infant.

Yet another embodiment of the blanket with audio device provides a plurality of functions and controls of the audio device. The elevated control panel and buttons feature Braille letters whereby a visually impaired person can also fully operate the controls. The controls and functions with Braille letters include record, erase, play, and stop.

The blanket is preferably equipped with an upper border and is offered in a plurality of designs and colors. The blanket is soft and pliable. The audio device recession is preferably located in a bottom corner of the blanket but is not limited to such.

Thus has been broadly outlined the more important features of the improved blanket with audio device so that the detailed description thereof that follows may be better understood and in order that the present contribution to the art may be better appreciated.

Therefore, an object of the blanket with audio device to provide comfort to a child.

Another object of the blanket with audio device is to partially conceal the audio device.

A further object of the blanket with audio device is to provide manual control of the audio device.

It is an added object of the blanket with audio device to provide at least partial voice activated control of the audio device.

Additionally, it is an object of the blanket with audio device to provide audio device control for the visually impaired.

And, it is an object of the blanket with audio device to provide visual access to the audio device.

Further, it is an object of the blanket with audio device to provide a removable audio device.

An added object of the blanket with audio device is to provide a waterproof audio device.

Another object of the blanket with audio device is to provide for recording, erasing, and playback of audio.

These together with additional objects, features and advantages of the improved blanket with audio device will be readily apparent to those of ordinary skill in the art upon reading the following detailed description of presently preferred, but nonetheless illustrative, embodiments of the improved blanket with audio device when taken in conjunction with the accompanying drawings.

In this respect, before explaining the current embodiments of the improved blanket with audio device in detail, it is to be understood that the blanket with audio device is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved blanket with audio device. It is therefore important that the claims be regarded as including such equivalent constructions insofar as they do not depart from the spirit and scope of the blanket with audio device. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the blanket with audio device apparatus generally designated by the reference number 10 will be described.

Figure 1:
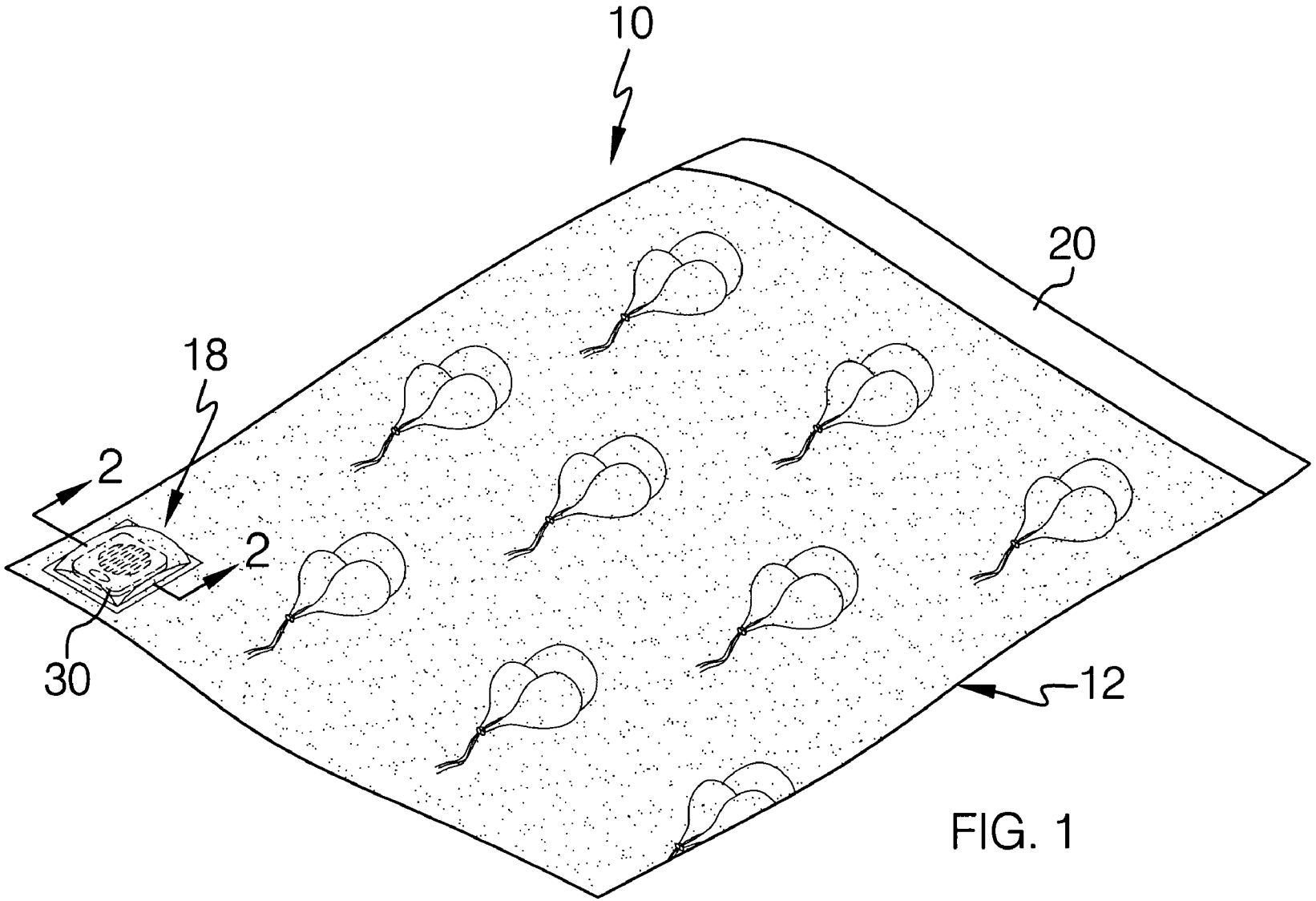
FIG. 1 is a perspective view.
Figure 2:
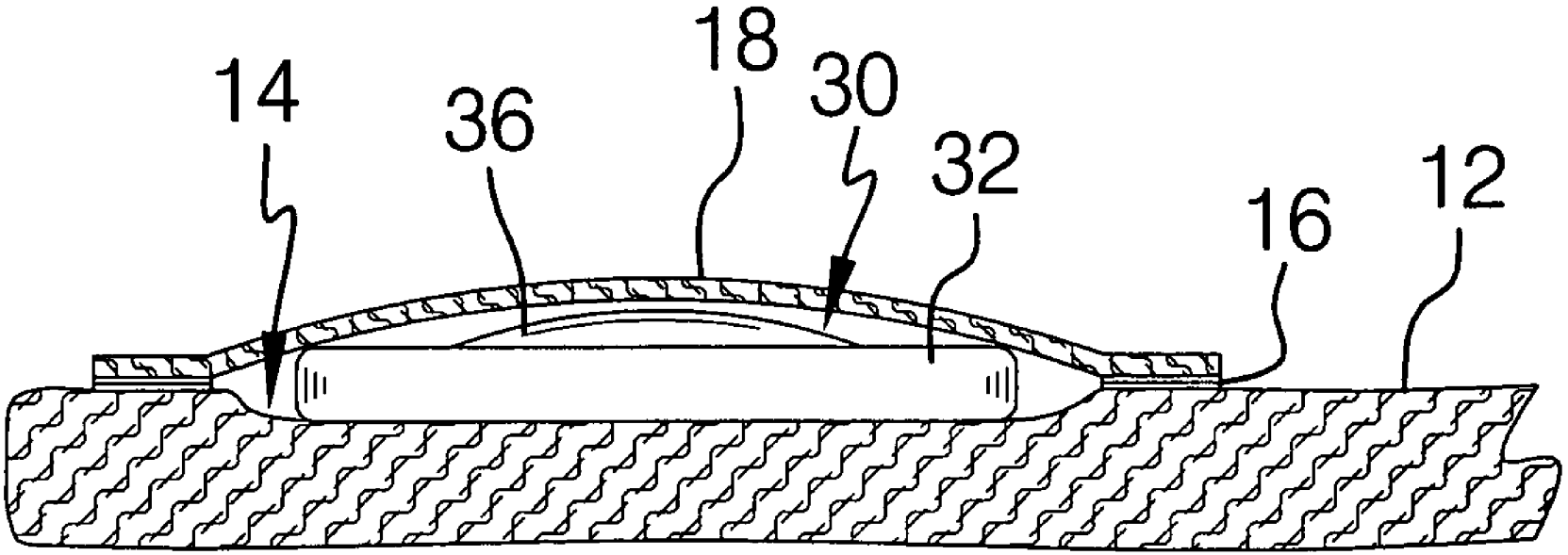
FIG. 2 is a cross sectional view of FIG. 1, taken along the line 2-2.
Figure 3:
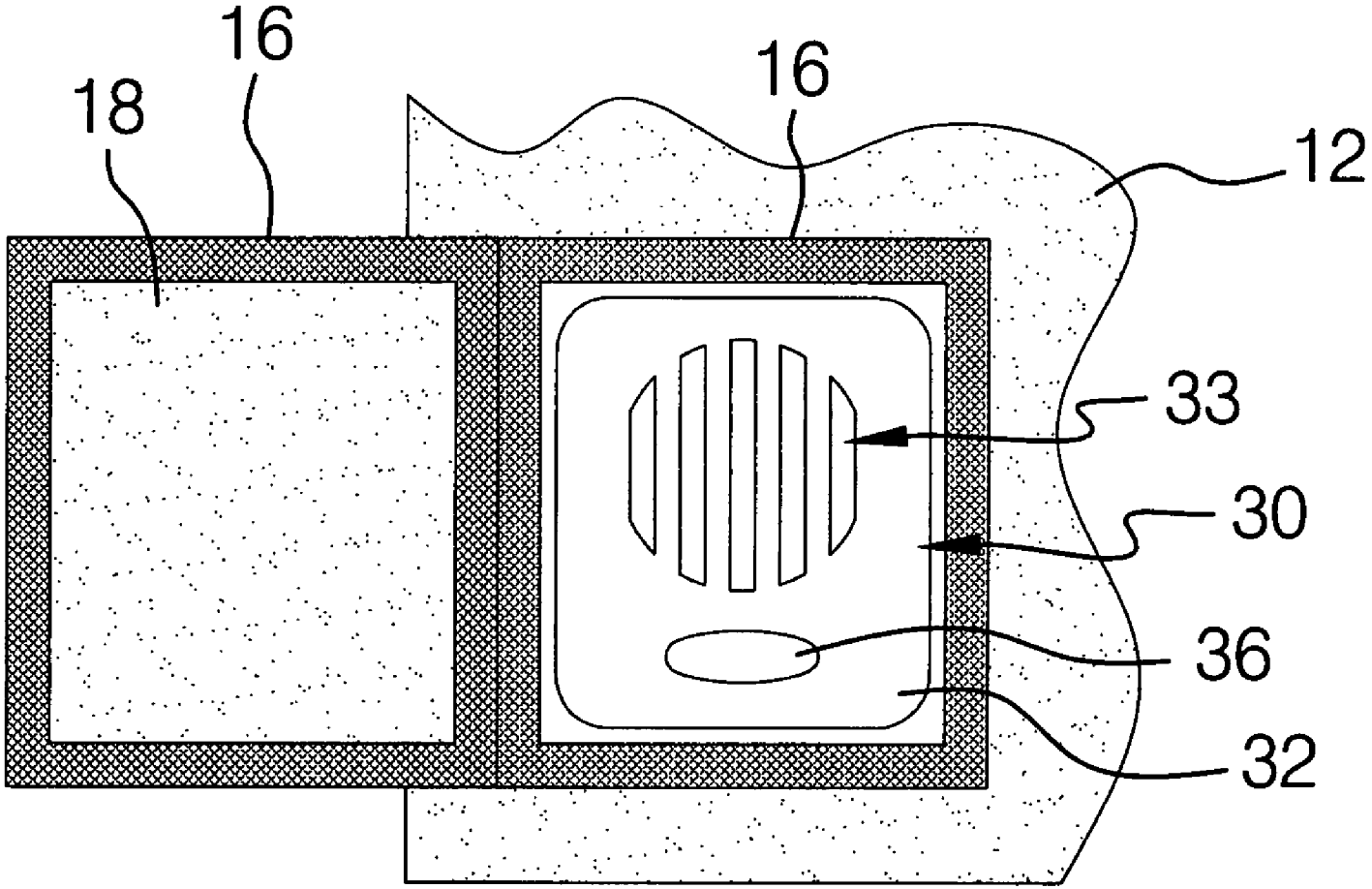
FIG. 3 is a top plan view of the corner portion of the blanket housing one embodiment of the audio device.

Referring to FIGS. 1, 2, and 3, the blanket apparatus 10 has a top side, a bottom side, four borders, and a thickness therebetween. The substantially rectangular recession 14 is disposed in a part of the thickness adjacent to the top side of the blanket 12. The audio device 30 is removably disposed within the recession 14. The transparent removable cover flap 18 covers the recession 14. The cover flap 18 is preferably removably retained with hook and loop 16. Even though the audio device 30 is waterproof, the cover flap 18 provides for access and removal of the audio device 30 during washing and the like of the blanket 12. The audio device 30 has a length, a width, and a thickness. The audio device 30 is capable of start and stop via the on/off 36. The on/off 36 is elevated above the thickness of the audio device case 32. The speaker 33 is within the case 32.

Figure 4:
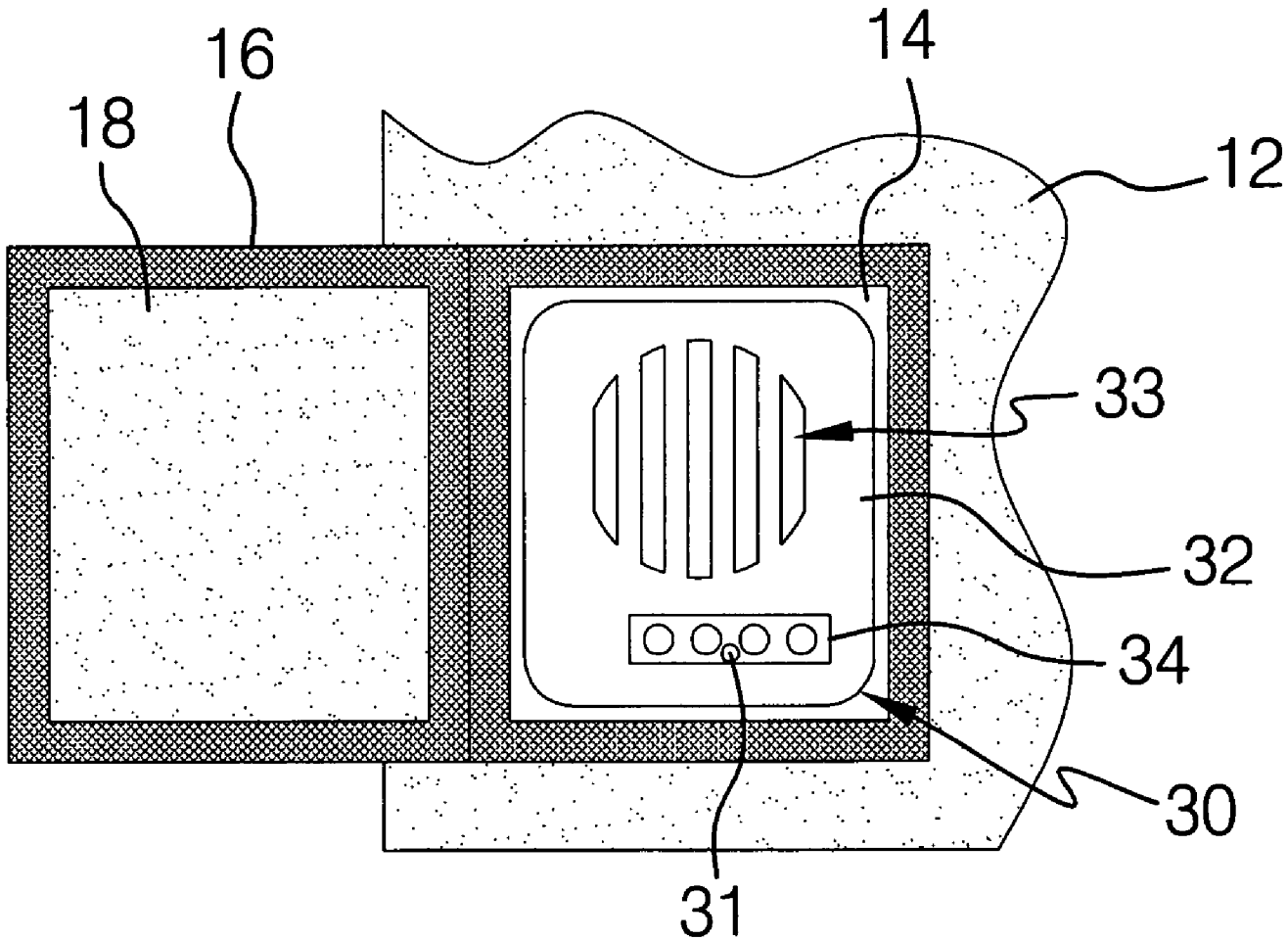
FIG. 4 is a top plan view of the corner portion of the blanket housing an embodiment of the audio device different from that of FIG. 4.

Referring to FIG. 4, a different embodiment of the audio device 30 of the apparatus 10 comprises a case 32. The speaker 33 is disposed within the case 32. The audio device 30 is further comprised of control panel 34. Panel 34 contains the sensor/switch 31 for voice activation of the audio device 30. The voice activation switch 31 enables voice control for on/off of the audio device 30. The control panel 34 comprises a record button 37, an erase button 38, a play button 30, and a stop button 40. A Braille R is disposed on the record button 37. A Braille E is disposed on the erase button 38. A Braille P is disposed on the play button 39. A Braille S is disposed on the stop button 40. The sensor/switch 31, transparent flap 18, elevated control panel 34, and the Braille buttons 37, 38, 39, and 40 thereby provide visual, audible, and palpable access to the control panel 34 of the audio device 30.

Figure 5:
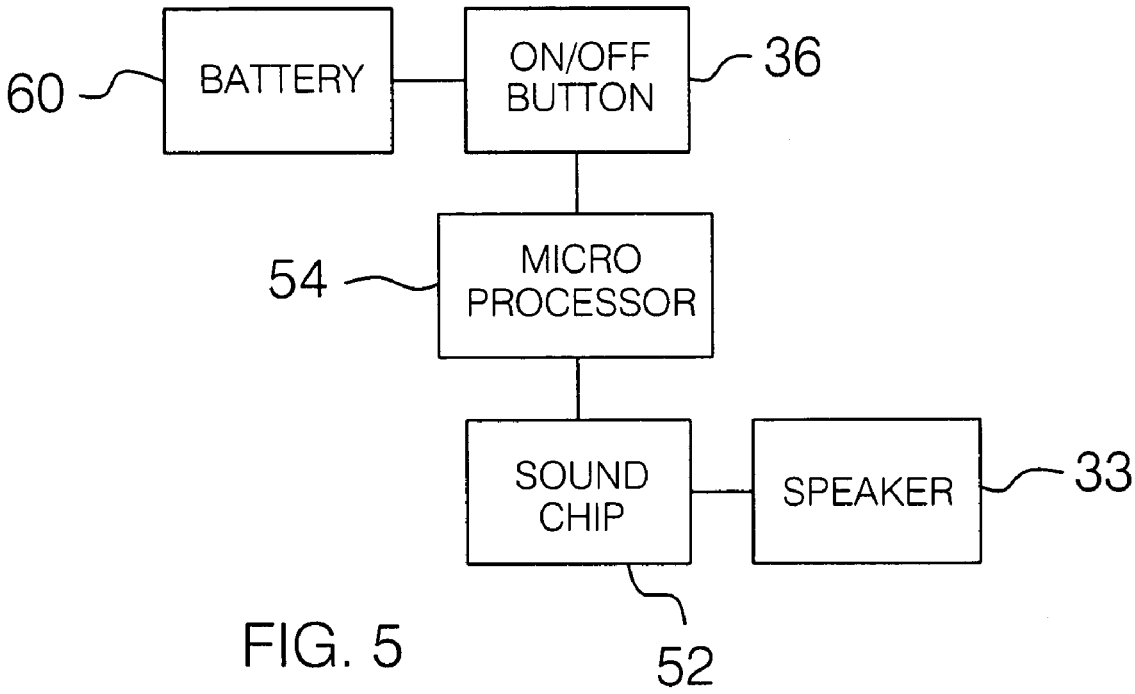
FIG. 5 is a block diagram of the components of one embodiment of the audio device.

Referring to FIG. 5, one embodiment of the apparatus 10, as is illustrated further in FIGS. 2 and 3, comprises a battery 60. The battery 60 is in direct communication with the on/off 36. The on/off 36 controls the microprocessor 54. The microprocessor 54 is in communication with the sound chip 52. The sound chip 52 is preferably recorded with nursery tunes, lullabies, and the like. The sound chip 52 is in direct communication with the speaker 33.

Figure 6:
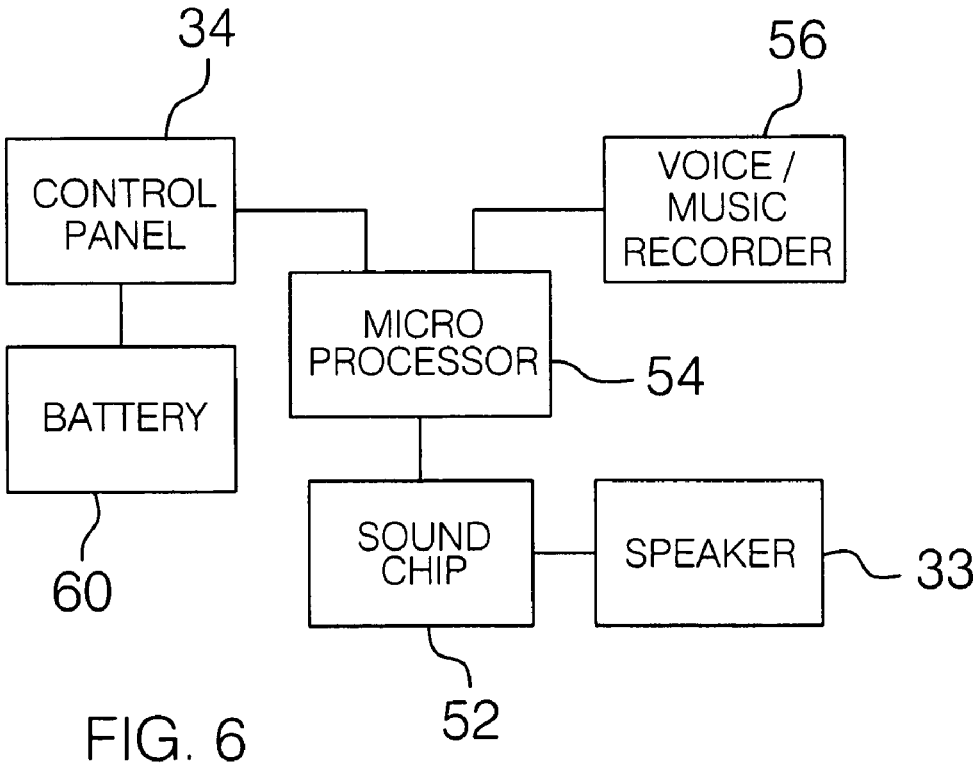
FIG. 6 is a block diagram of an embodiment of the audio device different from that of FIG. 5.
Figure 7:
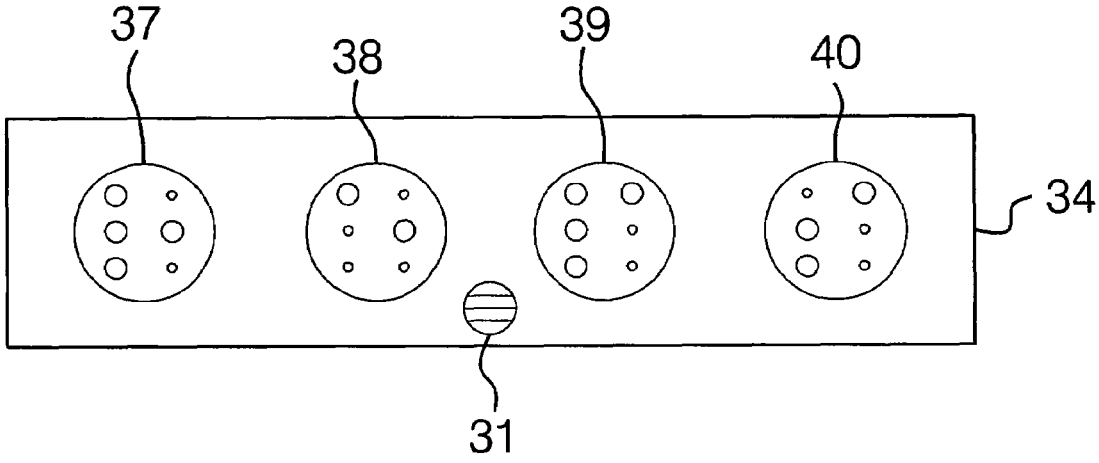
FIG. 7 is a top plan view of the control panel.

Referring to FIGS. 6 and 7, the embodiment of the apparatus 10 further illustrated in FIG. 4 comprises the audio device 30 which houses the block diagram components. The battery 60 powers the audio device 30. The control panel 34 houses the record button 37 with Braille R. The panel 34 further houses the erase button 38 with Braille E. The panel 34 houses the play button 39 with Braille P. The panel 34 houses the stop button 40 with Braille S. The control panel 34 also houses the sensor/switch 31 which provides voice activated on/off of the playback of the audio device 30. The thin, highly flexible flap 18 and the pronounced profile R, E, P, and S of the control buttons 37, 38, 39, and 40, respectively, provide for palpable control of the functions of the control panel 34.

With respect to the above description then, it is to be realized that the optimum dimensional relationships for the parts of the blanket with audio device, to include variations in size, materials, shape, form, function and the manner of operation, assembly and use, are deemed readily apparent and obvious to one skilled in the art, and all equivalent relationships to those illustrated in the drawings and described in the specification and intended to be encompassed by the blanket with audio device.

Directional terms such as “front”, “back”, “in”, “out”, “downward”, “upper”, “lower”, and the like may have been used in the description. These terms are applicable to the embodiments shown and described in conjunction with the drawings. These terms are merely used for the purpose of description in connection with the drawings and do not necessarily apply to the position in which the blanket with audio device may be used.

Therefore, the foregoing is considered as illustrative only of the principles of the blanket with audio device. Further, since numerous modifications and changes will readily occur to those skilled in the art, it is not desired to limit the blanket with audio device to the exact construction and operation shown and described, and accordingly, all suitable modifications and equivalents may be resorted to, falling within the scope of the blanket with audio device.

What is claimed is:

1. A blanket apparatus with a removable audio device, the apparatus comprising:

a blanket having a top side, a bottom side, four borders, and a thickness therebetween;

a substantially rectangular recession disposed in a part of the thickness adjacent to the top side of the blanket;

a transparent removable cover flap for covering the recession;

a means for retention of the cover flap;

an audio device removably disposed within the recession and under the cover flap, the audio device having a length, a width, and a thickness, the audio device capable of record, erase, and playback;

at least one speaker within the audio device;

at least one control on the audio device, the control elevated above the thickness of the audio device, the control comprising:

a sensor/switch for voice activation;

a record button;

a Braille R on the record button;

an erase button;

a Braille E on the erase button;

a play button;

a Braille P on the play button;

a stop button;

a Braille S on the stop button;

whereby the control is visually, audibly, and palpably accessed.

2. The apparatus in claim 1 wherein the audio device is waterproof.

3. The apparatus in claim 1 wherein the audio device is prerecorded with a quantity of music.

4. The apparatus in claim 2 wherein the audio device is prerecorded with a quantity of music.

5. The apparatus in claim 4 wherein the blanket is further comprised of a border at an upper end of the blanket.

6. The apparatus in claim 5 wherein the recession and cover flap are located proximal to a corner in a lower end of the blanket.

* * * * *